US007090027B1

(12) United States Patent
Williams

(10) Patent No.: US 7,090,027 B1
(45) Date of Patent: Aug. 15, 2006

(54) CASING HANGER ASSEMBLY WITH RUPTURE DISK IN SUPPORT HOUSING AND METHOD

(75) Inventor: Gregory D. Williams, Houston, TX (US)

(73) Assignee: Dril_Quip, Inc., Houston, TX (US)

( * ) Notice: Subject to any disclaimer, the term of this patent is extended or adjusted under 35 U.S.C. 154(b) by 86 days.

(21) Appl. No.: 10/706,206

(22) Filed: Nov. 12, 2003

Related U.S. Application Data

(60) Provisional application No. 60/425,402, filed on Nov. 12, 2002.

(51) Int. Cl.
*E21B 34/00* (2006.01)

(52) U.S. Cl. ..... 166/386; 166/376; 166/317; 166/191; 137/68.23

(58) Field of Classification Search ..... 166/363, 166/364, 376, 386, 317, 191; 137/68.23
See application file for complete search history.

(56) References Cited

U.S. PATENT DOCUMENTS 2,178,845 A * 11/1939 Baker ..... 166/317
3,744,562 A * 7/1973 Priebe et al ..... 166/363
6,457,528 B1 10/2002 Staudt
6,591,915 B1 * 7/2003 Burris et al. ..... 166/376

* cited by examiner

*Primary Examiner*—David Bagnell
*Assistant Examiner*—Matthew J. Smith
(74) *Attorney, Agent, or Firm*—Browning Bushman P.C.

(57) ABSTRACT

A casing hanger support assembly supports an inner casing string within a well containing an outer casing string and a production tubing string. The casing hanger support housing supports the casing hanger in the well, with a casing hanger being secured to an upper end of the inner casing string. One or more of a rupture disk and a blowout plug are provided in a wall of the casing hanger support housing for maintaining the desired pressure differential between an annulus within the outer casing string and an annulus exterior of the outer casing string, thereby preventing casing collapse or burst.

15 Claims, 2 Drawing Sheets

CASING HANGER ASSEMBLY WITH RUPTURE DISK IN SUPPORT HOUSING AND METHOD

RELATED CASE

The present application claims priority from U.S. Ser. No. 60/425,402 filed on Nov. 12, 2002.

BACKGROUND OF THE INVENTION

Hydrocarbon recovery wells conventionally involve sequential casing strings, with each string being smaller in diameter than the next outer string. Each casing string may be secured with a casing hanger to a casing hanger housing. The annulus between differing diameter casing strings is conventionally filled with cement to a level that overlaps the bottom of the larger diameter casing string. The cement bonds with the open soil and with larger diameter casing strings to form an annular seal in a lower portion of the well. The casing string typically has a mechanical seal on the casing hanger that forms an upper barrier for the annulus between the casing strings. The seal on top of the annulus on the casing hanger and the seal on the bottom provided by the cement form a closed, fluid filled annulus.

If the well is brought into production, the production tubing will provide the flow path with oil or gas to the surface production equipment. During production, the tubing experiences temperature changes due to reservoir fluid temperature, which may be substantial. The heat from the production tubing is liberated to the surrounding larger casing strings and annuli. If the temperature of the fluid in the annuli rises, so does fluid pressure. If the increased pressure is not allowed to vent, it may burst the larger casing or collapse the smaller casing. Collapsed casing will likely damage control lines controlling the flow of the hydrocarbons through the production tubing, and may create environmental and safety concerns by not being able to close downhole valves along the production tubing string.

A rupture disk or blowout plug in a well will allow trapped pressure to vent to an area that is not trapped, and may eventually vent to the atmosphere, which may be hydrostatic sea pressure. Rupture disks may be placed into the tubular connectors which couple the casing joints together to form the casing string, as disclosed in U.S. Pat. No. 6,457,582. Rupture disks and blowout plugs have also been placed in a casing hanger to control the pressure differential between the interior of the casing string hung by the casing hanger and the outer casing, wellhead or other support housing surrounding and supporting the casing hanger. In this application, the rupture disk may be selectively ruptured to monitor annulus pressure at the surface, but does not prevent collapse of the casing.

The disadvantages of the prior art are overcome by the present invention. Improved fluid pressure control in a well is provided by the present invention.

SUMMARY OF THE INVENTION

A casing hanger support assembly is provided for supporting an inner casing string within a well which contains an outer casing string. A casing hanger support housing is provided at the upper end of the outer casing string, and supports the inner casing hanger and the inner casing string in the well. The casing hanger is secured to the upper end of the inner casing string, and lockdown members axially connect the casing hanger to the support housing. One or more rupture disks and/or blowout plugs may be provided in the wall of the casing hanger support housing to maintain a desired pressure differential between the annulus between the inner and outer casing strings and the exterior of the outer casing string.

By providing the rupture disk or blowout plug within the casing hanger support housing, the plug or disk may be located above the level of cement between the inner casing string and the outer casing string, thereby minimizing the likelihood of clogging or plugging the rupture disk or blowout plug.

A significant advantage of the present invention is that the likelihood of collapsing the casing may be substantially reduced by using a rupture disk or blowout plug which is not positioned within the casing string itself.

These and further features and advantages of the present invention will become apparent from the following detailed description, wherein reference is made to the figures in the accompanying drawings.

DETAILED DESCRIPTION OF THE PREFERRED EMBODIMENTS

Figure 1:
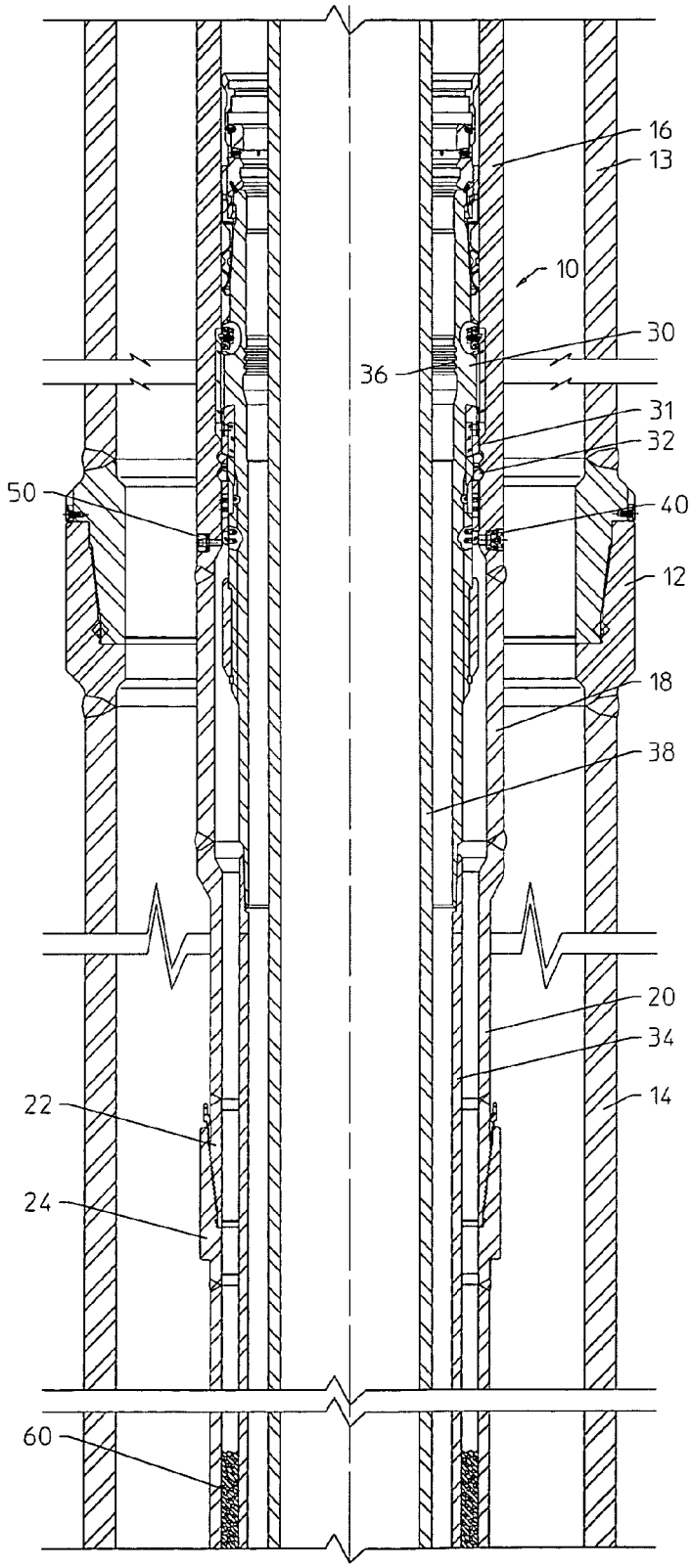
FIG. 1 is a cross sectional view of a casing hanger support assembly according to the present invention.

The present invention provides a rupture disk or blowout plug installed in the wall of the casing hanger support housing. A rupture disk or blowout plug may be placed at various locations along the length of a casing string, but also may be covered by the cement column or by debris within the fluid, thereby preventing the operation of the disk or plug. FIG. 1 shows both a rupture disk 50 and a blowout plug 40 installed or a casing hanger support housing 16, which in the depicted embodiment is a supplemental adapter for supporting an inner casing string 34. The plug or disk is thus located "high" in the sealed annulus within the well and minimizes the chance of cement or debris clogging or plugging the rupture disk or blowout plug. The casing hanger support housing 16 is thus a generally tubular housing which supports the casing hanger 30 and the inner casing string 34 supported from that hanger. In FIG. 1, the casing hanger assembly 10 includes the support housing 16 with both a rupture disk 50 and blowout plug 40 installed in the wall of the casing hanger support housing. One or either of a rupture disk 50 and blowout plug 40 are used according to the present invention.

For the embodiment depicted in FIG. 1, the outer casing 20 is secured to the casing hanger support housing 16, and is positioned within yet another casing, which may be a surface casing with joint 13 connected to joint 14 by a threaded connector 12. The support housing may be at the top of the outer casing, or may be positioned at a desired location along the length of the outer casing. In some applications, the housing 16 will be at the upper end of the outer casing. A lower extension 18 secured to the support housing 16 connects the casing hanger support 16 to the outer casing 20, which may include connectors 22, 24 for connecting lengths of the outer casing string. The disk 50 or the blowout plug 40 alternatively may be placed in the extension 18, which functionally is a component of the support housing 18. The annulus between the support casing string 34 and the outer casing string 20 is thus shown with a cement material 60 in FIG. 1. Alternative materials and techniques may be used to seal the annulus in the lower end of the wellbore. A tubular 38 is also provided within the inner casing 34.

Casing hanger 30 includes a seal assembly 31 and lockdown member 32 for sealing and locking the casing hanger 30 to the support housing 16. Casing hanger 30 is thus sealed to the housing 16, and is locked in place with lock down members which cooperate with the grooves in the interior surface of the housing 16. Internal lockdown grooves 36 may also be provided on the hanger 30.

Figure 2:
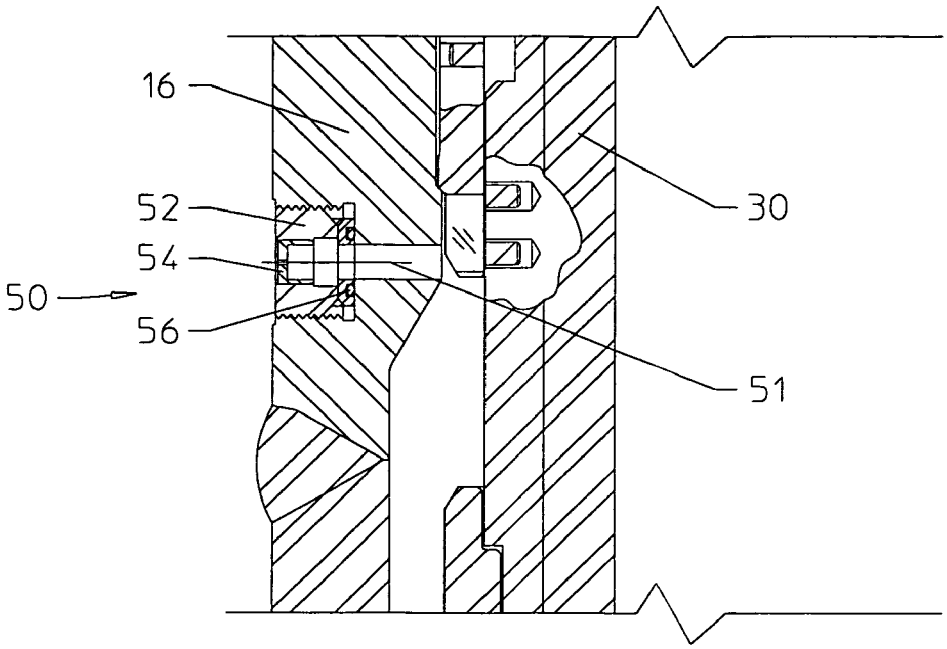
FIG. 2 is a detailed cross sectional view of a suitable rupture disk in the wall of the casing hanger support housing.

FIG. 2 depicts in greater detail the rupture disk 50 which is in communication with bore 51 in the wall of the casing hanger support 16. The rupture disk 54, e.g., of a ceramic or metallic material, may be provided within the internal bore in threaded member 52, which sealingly engages the housing 16 by seal 56. A pressure differential may exist across the housing 16, and the disk 54 may rupture to equalize the pressure across the casing string 34.

Figure 3:
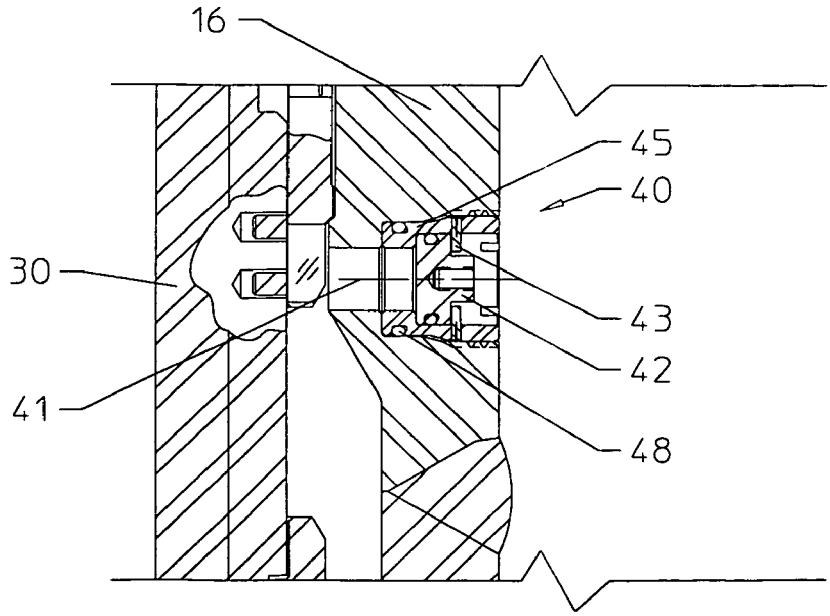
FIG. 3 is a cross sectional view of a suitable blowout plug positioned within the wall of the casing hanger support housing.

FIG. 3 similarly disclosed a blowout plug 40 positioned in the wall of casing hanger support 16 having a bore 41. Sleeve 45 is connected with plug 42 by one or more shear members, such as pins 43, which release the blowout plug in response to a predetermined pressure differential. Seals 48 provide sealed engagement of the plug with the sleeve 45 and the sleeve 45 with the support housing 16.

The support housing 16 for the casing hanger 20 may be a landing sub, or any type of housing intended for landing the casing hanger thereon. The rupture disk and/or blowout plug positioned in the well within the wall of the support housing 16 may thus be used to relieve pressure buildup between the annulus surrounding an outer casing string 20 secured to the support housing 16 and the annulus between the outer casing string 20 and the inner casing string 34 supported on the support housing 16. Pressure relief may be from inside the outer casing 20 to outside the casing 20, or from outside the outer casing 20 to inside the outer casing 20.

While preferred embodiments of the present invention have been disclosed, it is apparent that modifications and adaptations of the preferred embodiments will occur to those skilled in the art. However, it is to be expressly understood that such modifications and adaptations are within the spirit and scope of the present invention as set forth in the following claims.

The invention claimed is:

1. A casing hanger support assembly for supporting an inner casing string within a well containing an outer casing string, comprising:

a casing hanger support housing positioned along the outer casing string for supporting a casing hanger and the inner casing string in the well;

the casing hanger secured to an upper end of the inner casing string for mating engagement with the casing hanger support housing; and one of a rupture disk and a blowout plug in a wall of the casing hanger support housing for maintaining a desired pressure differential between an interior and an exterior of the outer casing string.

2. A casing hanger support assembly as defined in claim 1, wherein the casing hanger includes a seal assembly for sealing with the casing hanger support housing and one or more lockdown members for fitting within a lockdown groove in an interior surface of the casing hanger support housing.

3. A casing hanger support assembly as defined in claim 1, wherein the rupture disk includes one of ceramic disk and a metallic disk.

4. A casing hanger support assembly as defined in claim 1, wherein the blowout plug includes a shear member to release the blowout plug in response to a predetermined pressure differential.

5. A casing hanger support assembly as defined in claim 1, wherein the inner casing string receives a tubing string suspended in the well.

6. A casing hanger support assembly for supporting an inner casing string within a well containing an outer casing string and a production tubing string within the inner casing string for recovering production fluids, the casing hanger support assembly comprising:

a casing hanger support housing along the outer casing string for supporting a casing hanger and the inner casing string in the well;

the casing hanger secured to an upper end of the inner casing string for mating engagement with the casing hanger support housing; and one of a rupture disk and a blowout plug in a wall of the casing hanger support housing for maintaining a desired pressure differential between a space within the outer casing string and a space exterior of the outer casing string.

7. A casing hanger support assembly as defined in claim 6, wherein the casing hanger includes a seal assembly for sealing with the casing hanger support housing.

8. A casing housing support assembly as defined in claim 6, wherein the casing hanger includes one or more lockdown members for fitting within a lockdown groove in an interior surface of the casing hanger support housing.

9. A casing hanger support assembly as defined in claim 6, wherein the rupture disk includes one of ceramic disk and a metallic disk.

10. A casing hanger support assembly as defined in claim 6, wherein the blowout plug includes a shear member to release the blowout plug in response to a predetermined pressure differential.

11. A method of preventing rupture or collapse of a casing string in a well, comprising:

providing a casing hanger support housing along an outer casing string for supporting an inner casing string and a casing hanger in the well;

securing the casing hanger to an upper end of the inner casing string and axially connecting the casing hanger with the casing hanger support housing; and providing one of a rupture disk and a blowup plug in a wall of the casing hanger support housing to maintain a desired pressure differential between a space within the outer casing string and a space exterior of the outer casing string.

12. A method as defined in claim 11, further comprising:

providing a seal assembly for sealing between the casing hanger and the casing hanger support housing.

13. A method as defined in claim 11, further comprising:

providing one or more lockdown members for fitting within a lockdown groove in an interior surface of the casing hanger support housing.

14. A method as defined in claim 11, further comprising:

recovering production fluids from the well through a production tubing string interior of the inner casing string.

15. A method as defined in claim 11, further comprising:

filling an annulus between the outer casing string and the inner casing string with a cement material; and positioning one of the rupture disks and the blowout plug above an upper end of the cement material.

* * * * *